US005537983A

United States Patent [19]

Nakajima

[11] Patent Number: 5,537,983

[45] Date of Patent: Jul. 23, 1996

[54] IGNITION SYSTEM FOR INTERNAL COMBUSTION ENGINE

[75] Inventor: Keichi Nakajima, Yokkaichi, Japan

[73] Assignee: Sumitomo Wiring Systems, Ltd., Japan

[21] Appl. No.: 534,190

[22] Filed: Sep. 26, 1995

[30] Foreign Application Priority Data

Nov. 17, 1994 [JP] Japan ..... 6-283090

[51] Int. Cl.[6] ..... F02P 3/02

[52] U.S. Cl. ..... 123/635; 123/169 PA; 336/107

[58] Field of Search ..... 123/634, 635, 123/169 PA; 336/107

[56] References Cited

U.S. PATENT DOCUMENTS 4,947,809 8/1990 Hocking ..... 123/169 PA 5,170,767 12/1992 Wada et al. ..... 123/634

5,357,233 10/1994 Wada ..... 336/107

5,391,100 2/1995 Maruyama et al. ..... 445/7

*Primary Examiner*—Andrew M. Dolinar

*Attorney, Agent, or Firm*—Jordan B. Bierman; Bierman and Muserlian

[57] ABSTRACT

There is disclosed an ignition system for an internal combustion engine wherein insertion of a terminal (41) into a sleeve (55) from above a cap (51), with an upper portion of the sleeve (55) fitted in a sleeve receiving portion (51*b*) of the cap (51), causes a ledge (42) on an upper portion of the terminal (41) to advance beyond a ledge (53) of the cap (51) made of rubber into a position lower than the ledge (53), whereby an upper side of the ledge (42) engages the ledge (53) to prevent the upward movement of the terminal (41) and a lower side of the ledge (42) is locked to an upper end surface of the sleeve (55) to prevent the terminal (41) from slipping off downwardly, thereby completely positioning the terminal (41).

7 Claims, 8 Drawing Sheets

IGNITION SYSTEM FOR INTERNAL COMBUSTION ENGINE

BACKGROUND OF THE INVENTION

1. Field of the Invention

The present invention relates to an ignition system for an internal combustion engine for use in connection between a coil portion body of an ignition coil and a spark plug for the internal combustion engine.

2. Description of the Background Art

Distribution of high voltage to each spark plug by a distributor is disadvantageous in wear of a distributing portion including a distributor cap and a distributor rotor arm and in electrical noises from the distributing portion. To prevent such disadvantages, distributorless ignition systems have been proposed. One of the distributorless ignition systems is designed such that a conductor connecting portion directly connects a coil portion body for generating high voltage and a spark plug to provide the high voltage in the coil portion body to the spark plug, which is disclosed in, for example, Japanese Patent Application Laid-Open No. 5-52175 (1993), Japanese Utility Model Application Laid-Open No. 5-30467 (1993), and Japanese Patent Application Laid-Open No. 5-99112 (1993).

The conductor connecting portion generally comprises a conductive member such as a single spring, a metal round bar and a metal cylinder, and an insulating member for coating the conductive member. There are a variety of processes for positioning the conductive member relative to the insulating member.

For example, the conductive member is forced into the insulating member formed of a flexible rubber such as silicone rubber in a cylindrical shape. In another process, the insulating member comprises a sleeve which is a molded resin component, a rubber-made cap and bushing fitted on opposite ends of the sleeve, and the conductive member is inserted in the sleeve, or the sleeve and conductive member are formed into a unitary structure.

However, the first process might damage the insulating member made of silicone rubber and the like when receiving the conductive member to cause the damaged portion to be thinner, resulting in dielectric breakdown and low reliability. Further, the first process requires a large amount of costly silicone rubber, adding to material costs.

Forming the sleeve and conductive member into a unitary structure in the second process adds to fabrication costs because of the single-piece formation. Inserting the conductive member in the sleeve in the second process involves providing a stepped portion in the sleeve and a stepped portion in the conductive member for engaging the stepped portion of the sleeve for positioning the conductive member in the sleeve. In this case, there is a danger of the conductive member slipping off the sleeve unless the conductive member is coupled to parts of the ignition coil.

SUMMARY OF THE INVENTION

According to a first aspect of the present invention, an ignition system for an internal combustion engine comprises: an ignition coil having a high-tension terminal; a spark plug; and a conductor connecting portion including a conductive member for electrically connecting the high-tension terminal of the ignition coil and the spark plug, and an insulating member, the insulating member including a sleeve for receiving the conductive member, the sleeve being a molded resin component, and a cylindrical cap made of rubber and fitted on an upper end portion of the sleeve for covering an electrical connecting portion between the high-tension terminal of the ignition coil and an upper end portion of the conductive member, the conductive member having a first protrusion raised outwardly from an upper outer peripheral surface thereof and locked to an upper end surface of the sleeve, the cylindrical cap having a second protrusion on an inner peripheral surface thereof for engaging an upper side of the first protrusion to prevent the conductive member from slipping off.

Preferably, according to a second aspect of the present invention, the first protrusion is a projection formed on a part of the outer periphery of the conductive member, and the second protrusion is a ledge formed on the inner periphery of the cylindrical cap throughout the entire circumference.

Preferably, according to a third aspect of the present invention, the first protrusion is a ledge formed on the outer periphery of the conducive member throughout the entire circumference, and the second protrusion is a projection formed on a part of the inner periphery of the cylindrical cap. According to a fourth aspect of the present invention, an ignition system for an internal combustion engine comprises: an ignition coil having a high-tension terminal; a spark plug; and a conductor connecting portion including a conductive member for electrically connecting the high-tension terminal of the ignition coil and the spark plug, and an insulating member, the insulating member including a sleeve for receiving the conductive member, the sleeve being a molded resin component, and a cylindrical cap made of rubber and fitted on an upper end portion of the sleeve for covering an electrical connecting portion between the high-tension terminal of the ignition coil and an upper end portion of the conductive member the conductive member having a protrusion raised outwardly from an upper outer peripheral surface thereof, the cylindrical cap having a recess in an inner peripheral surface thereof for engaging the protrusion to prevent the conductive member from slipping off.

Preferably, according to a fifth aspect of the present invention, the protrusion is a projection formed on a part of the outer periphery of the conductive member.

Preferably, according to a sixth aspect of the present invention, the protrusion is a ledge formed on the outer periphery of the conductive member throughout the entire circumference.

According to a seventh aspect of the present invention, an ignition system for an internal combustion engine comprises: an ignition coil having a high-tension terminal; a spark plug; and a conductor connecting portion including a conductive member for electrically connecting the high-tension terminal of the ignition coil and the spark plug, and an insulating member, the insulating member including a sleeve for receiving the conductive member, the sleeve being a molded resin component, and a cylindrical cap made of rubber and fitted on an upper end portion of the sleeve for covering an electrical connecting portion between the high-tension terminal of the ignition coil and an upper end portion of the conductive member, the conductive member including a first stepped portion formed in an upper portion of an outer peripheral surface of the conductive member so that the outer diameter of a lower portion of the first stepped portion is greater than that of an upper portion thereof, and a second stepped portion formed in the outer peripheral surface of the conductive member under the first stepped portion so that the outer diameter of a lower portion of the second stepped portion is less than that of an upper portion thereof, the sleeve having a third stepped portion formed in an inner peripheral surface thereof for engaging the second stepped portion from below, the cylindrical cap having a fourth stepped portion formed in an inner peripheral surface thereof for engaging the first stepped portion from above.

In the ignition system according to the first to third aspects of the present invention, when the conductive member is inserted into the sleeve from above the cap, with the cap fitted on the upper portion of the sleeve, then the first protrusion, projection or ledge in the upper portion of the conductive member advances beyond the second protrusion, projection or ledge on the rubber-made cap into the position lower than the second protrusion, projection or ledge. The upper side of the first protrusion, projection or ledge engages the second protrusion, projection or ledge to prevent the upward movement of the conductive member. The lower side of the first protrusion, projection or ledge is locked to the upper end surface of the sleeve to prevent the conductive member from slipping off downwardly. This allows the complete positioning of the conductive member.

In the ignition system according to the fourth to sixth aspects of the present invention, when the conductive member is inserted into the sleeve from above the cap, with the cap fitted on the upper portion of the sleeve, then the protrusion, projection or ledge of the conductive member engages the recess of the cap, insuring the positioning of the conductive member in the sleeve.

In the ignition system according to the seventh aspect of the present invention, when the conductive member is inserted into the sleeve from above the cap, with the cap fitted on the upper portion of the sleeve, then the first stepped portion of the conductive member engages the fourth stepped portion of the cap to prevent the upward movement of the conductive member, and the second stepped portion of the conductive member engages the third stepped portion of the sleeve to prevent the conductive member from slipping off downwardly. This allows the complete positioning of the conductive member.

In this manner, the ignition system according to the present invention is designed to position the conducive member by locking or engaging the protrusion, projection, ledge or stepped portions of the conductive member to the upper end surface of the sleeve, the stepped portions in the inner surface of the sleeve, or the protrusion, ledge, projection or recess of the cap. This prevents the complicated shapes of the conductive member and insulating member and achieves fabrication of the mold or die at low costs, thereby reducing the costs of the respective parts. Additionally, there is no need to form the sleeve and the conductive member into a unitary structure. The ignition system may be readily assembled only by inserting the conductive member into the sleeve, achieving good workability and total fabrication cost reduction.

It is an object of the present invention to provide an ignition system for an internal combustion engine which has an improved structure for positioning a conductive member inserted in a sleeve and are of good assembly workability with a simple construction to ensure the positioning of the conductive member.

These and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
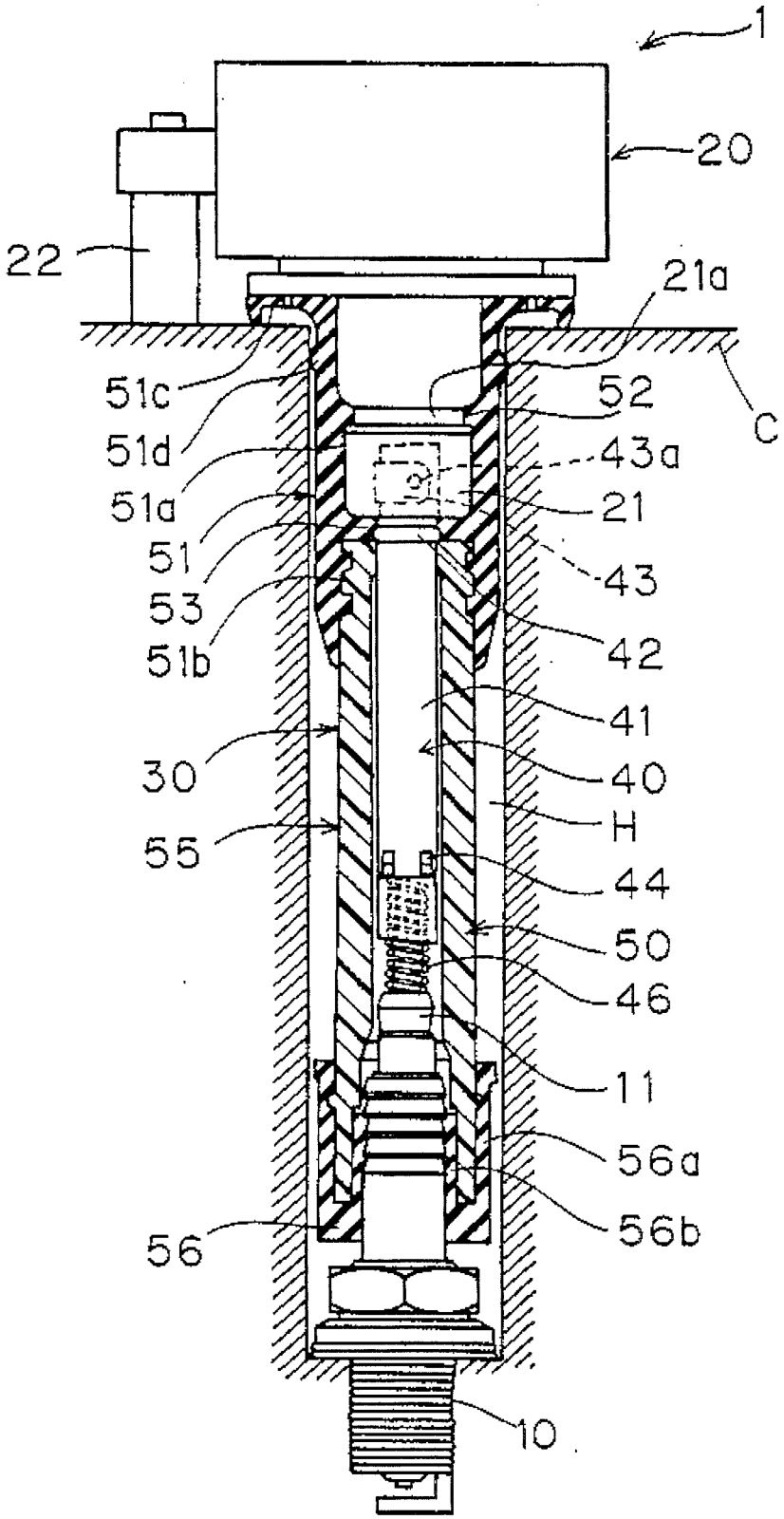
FIG. 1 is a fragmentary cross-sectional view of a first preferred embodiment according to the present invention.

Preferred embodiments according to the present invention will now be described with reference to the drawings. Referring to FIG. 1, an ignition system for an internal combustion engine comprises a spark plug 10 mounted in the bottom of a plug hole H formed in a cylinder head C so that a terminal 11 thereof projects upwardly, an ignition coil 20 mounted in an upper portion of the plug hole H by a support member 22 so that a high-tension tower 21 serving as an electrically connecting portion projects downwardly, and a conductor connecting portion 30 for electrical connection between the ignition coil 20 and the spark plug 10.

The conductor connecting portion 30, as shown in FIGS. 1 to 5, comprises a conductive member 40 including a cylindrical terminal 41 having an upper end fitted in the high-tension tower 21 of the ignition coil 20 and a coil spring 46 having an upper end portion inserted in the lower end portion of the terminal 41 and a lower end portion abutting against the top of the terminal 11 of the spark plug 10 when compressed, and an insulating member 50 for covering the conductive member 40.

Figure 2:
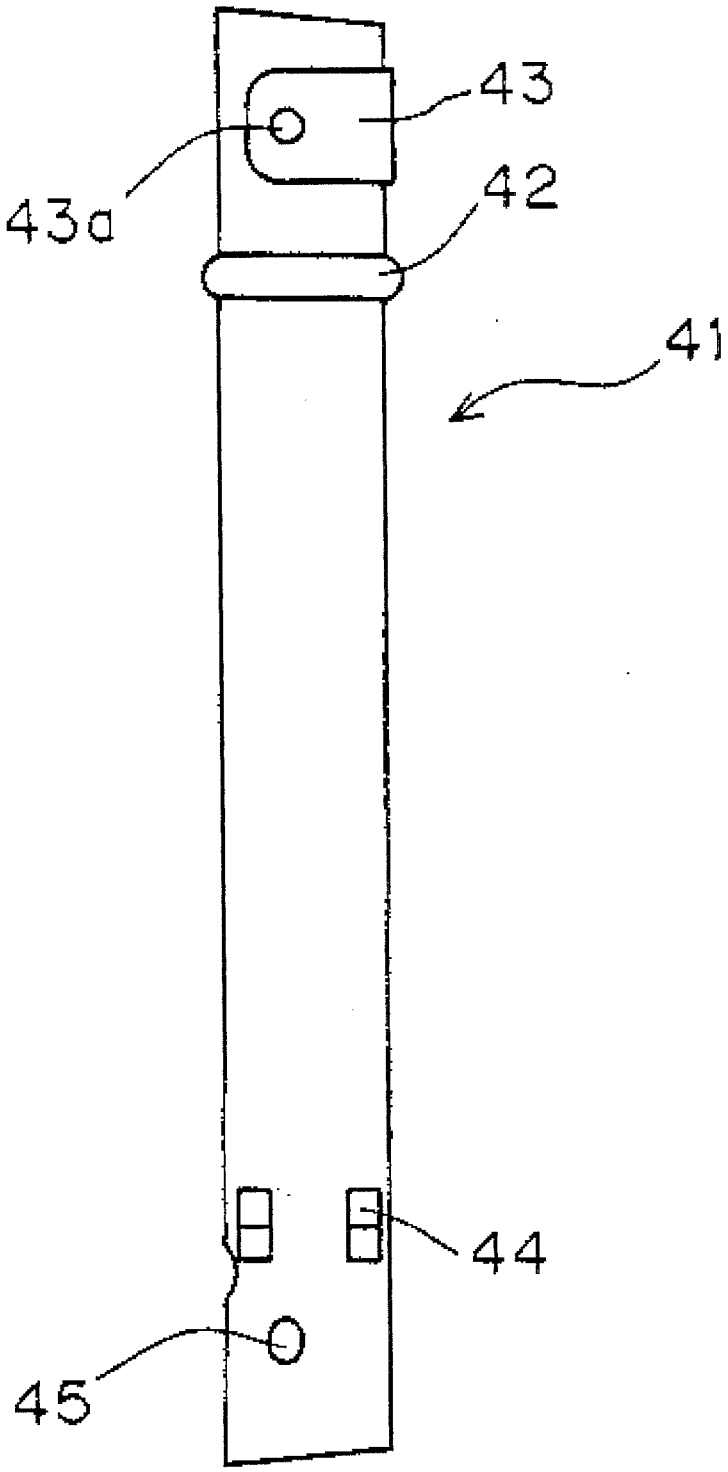
FIG. 2 is a side view of a terminal of the first preferred embodiment.

Referring to FIGS. 1 and 2, the terminal 41 is a cylinder made of a conductive metal having an outer diameter slightly smaller than the inner diameter of a sleeve 55 to be described later, with a resilient C-ring 43 in its upper end portion. The C-ring 43 has a pair of inward projections **43*a* on opposite ends of the inner surface thereof, and is mounted on the terminal 41 by inserting the projections 43*a* into through holes (not shown) in the upper end portion of the terminal 41. With the C-ring 43 mounted on the terminal 41, the projections 43*a* project from the inner surface of the terminal 41 and engage a high-tension terminal (not shown) projecting downwardly in the high-tension tower 21 of the ignition coil 20 when the high-tension terminal is inserted into the terminal 41 from above the terminal 41, thereby establishing electrical and mechanical connections between the terminal 41** and the high-tension terminal.

The terminal 41 includes, in its lower portion, contact portions 44 for the coil spring 46 which are formed by partially cutting and raising up an outer peripheral surface thereof inwardly, and a inward projection 45 under the contact portions 44. When the coil spring 46 is inserted into the terminal 41 from below the terminal 41, the top end of the coil spring 46 abuts against the contact portions 44 and the projection 45 fits in the upper side of the coil spring 46 to electrically connect the terminal 41 and coil spring 46 and support the coil spring 46 by the terminal 41.

The terminal 41 includes, in its upper portion, a ledge 42 under the C-ring 43 and projecting outwardly throughout the entire circumference. The ledge 42 has an outer diameter greater than the inner diameter of the sleeve 55 and is locked to the upper end surface of the sleeve 55 to restrict the downward movement of the terminal 41.

The insulating member 50 comprises a cap 51 made of silicone rubber for covering a range from the high-tension tower 21 to the upper portion of the terminal 41 connected to the high-tension terminal of the high-tension tower 21, a sleeve 55 molded with resin for covering a range from the upper portion of the terminal 41 to a portion of the terminal 11 of the spark plug 10, and a bushing 56 made of silicone rubber for covering the inner and outer surfaces of the lower portion of the sleeve 55.

Figure 3:
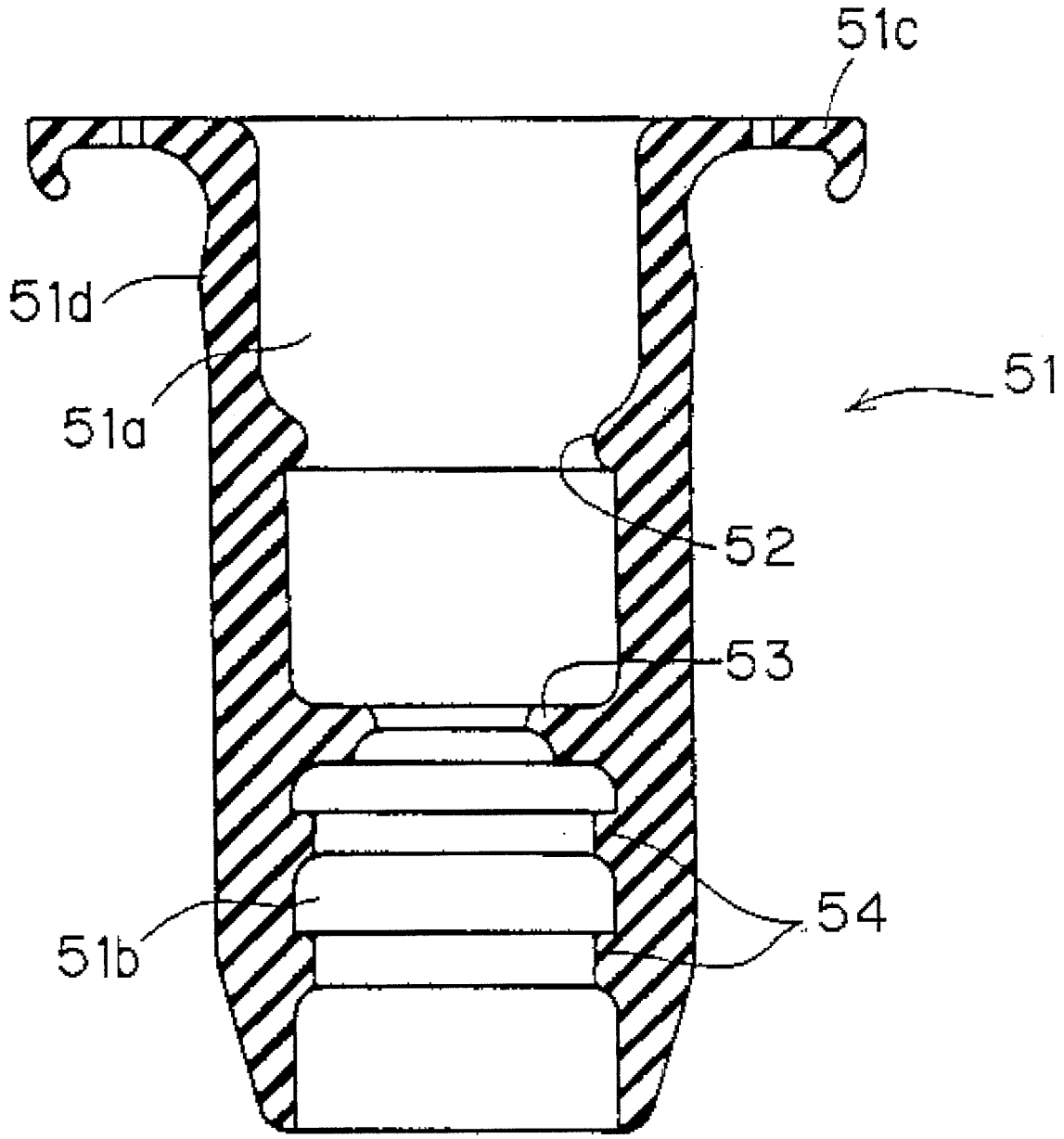
FIG. 3 is a cross-sectional view of a cap of the first preferred embodiment.

Referring to FIGS. 1 and 3, the cap 51 is a cylindrical member including a high-tension tower receiving portion 51*a* for receiving the high-tension tower 21 of the ignition coil 20, and a sleeve receiving portion 51*b* formed in continuation to the high-tension tower receiving portion 51*a* for receiving the upper portion of the sleeve 55, with a collar portion 51*c* extending radially outwardly from the top end of the high-tension tower receiving portion 51*a* and a bump portion 51*d* on the outer peripheral surface of the high-tension tower receiving portion 51*a*.

When the cap 51 is inserted into the plug hole H from the side of the sleeve receiving portion 51*b*, the collar portion 51*c* is locked to the upper surface of the cylinder head C on the periphery of the plug hole H and the bump portion 51*d* comes in intimate contact with the inner surface of the plug hole H.

A ledge 52 is formed on the inner peripheral surface of the high-tension tower receiving portion 51*a* throughout the enter circumference and is adapted to fit in and contact a groove 21*a* formed in the outer peripheral surface of the high-tension tower 21 when the high-tension tower 21 is inserted in the cap 51. A ledge 53 is formed under the ledge 52 on the inner peripheral surface of the sleeve receiving portion 51*b* throughout the entire circumference and engages the ledge 42 of the terminal 41 from above.

When the terminal 41 is inserted into the sleeve 55 from above the cap 51, with the upper portion of the sleeve 55 fitted in the sleeve receiving portion 51*b* of the cap 51, then the ledge 42 in the upper portion of the terminal 41 advances beyond the ledge 53 of the rubber-made cap 51 into the position lower than the ledge 53. The upper side of the ledge 42 engages the ledge 53 to prevent the upward movement of the terminal 41, and the lower side of the ledge 42 is locked to the upper end surface of the sleeve 55 to prevent the downward withdrawal of the terminal 41, thereby completely positioning the terminal 41.

The sleeve receiving portion 51*b* has two ledges 54 formed on the inner peripheral surface thereof for engaging two grooves 55*c* formed in the upper outer peripheral surface of the sleeve 55 throughout the entire circumference to provide high sealing performance between the sleeve 55 and the cap 51.

Figure 4:
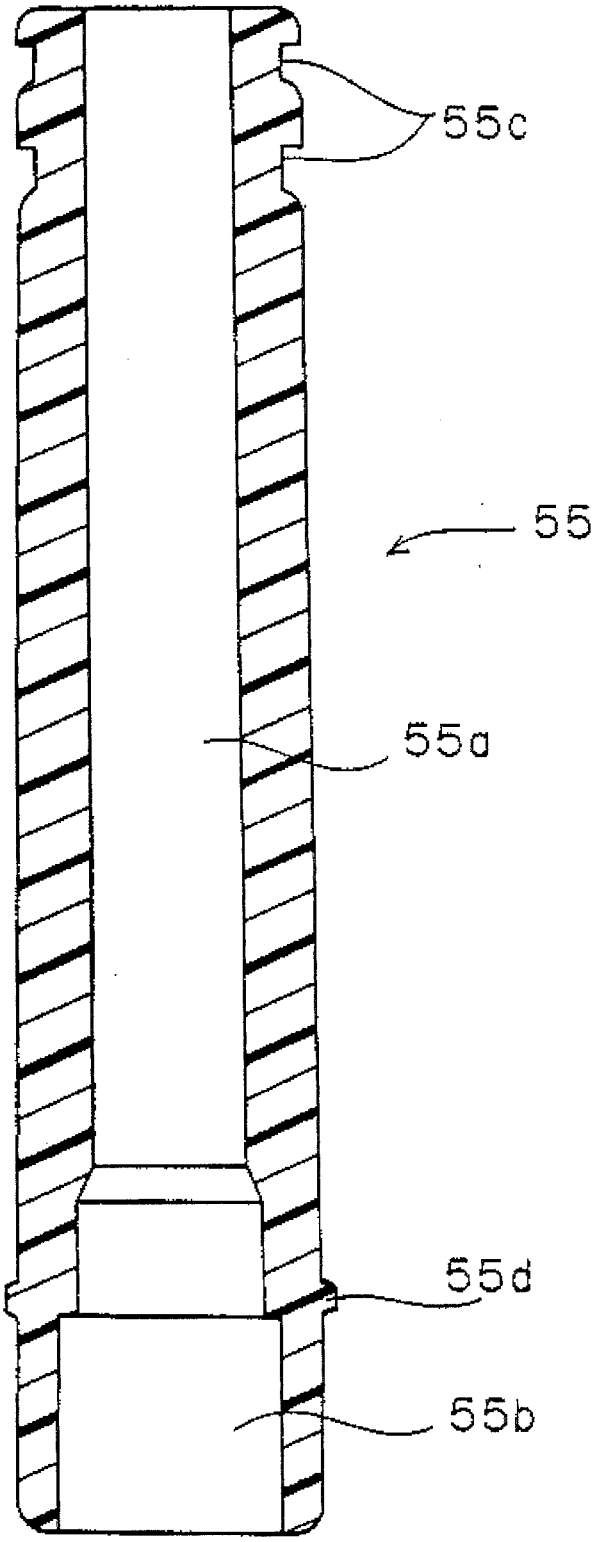
FIG. 4 is a cross-sectional view of a sleeve of the first preferred embodiment.

As illustrated in FIGS. 1 and 4, the sleeve 55 is a cylindrical molded resin component including a conductive member receiving portion 55*a* for receiving the conductive member 40, and a terminal receiving portion 55*b* formed in continuation to the conductive member receiving portion 55*a* for receiving the terminal 11 of the spark plug 10, with the above stated grooves 55*c* in the upper outer peripheral surface thereof and a ledge 55*d* on the lower outer peripheral surface thereof throughout the entire circumference.

Figure 5:
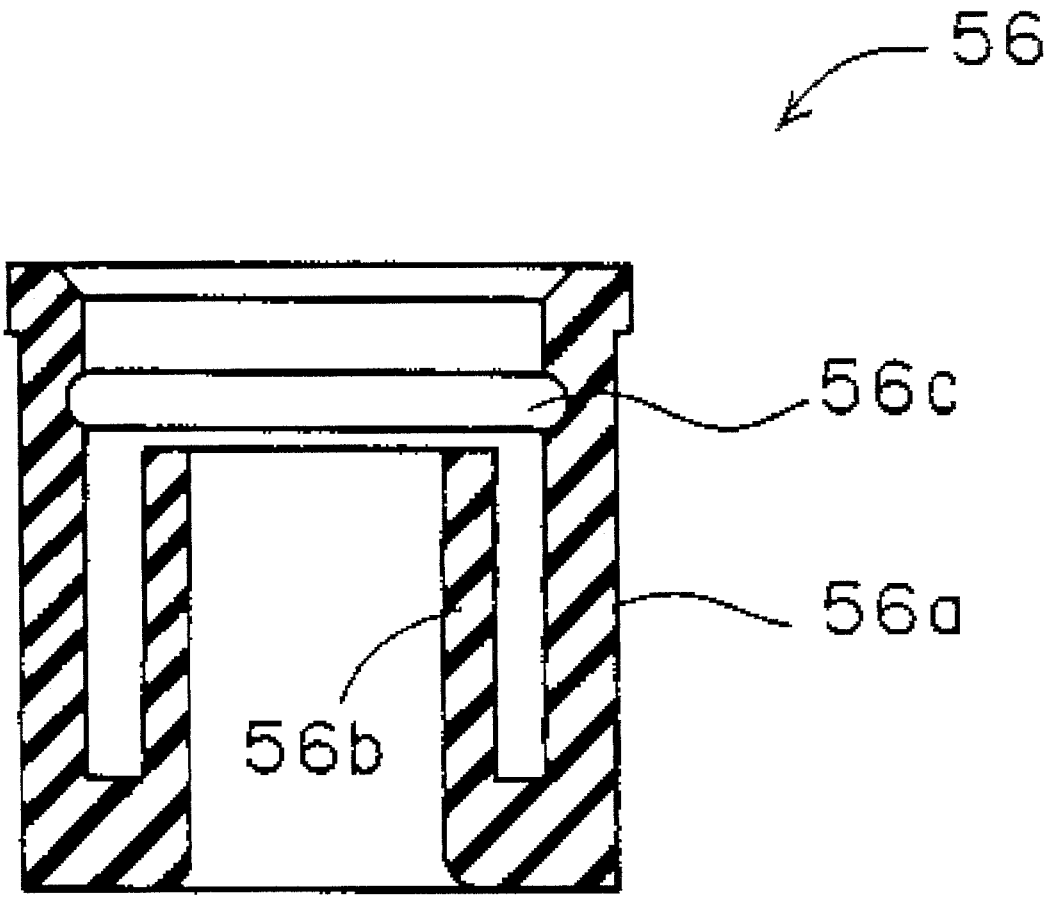
FIG. 5 is a cross-sectional view of a bushing of the first preferred embodiment.

With reference to FIGS. 1 and 5, the bushing 56 is mounted to the terminal receiving portion 55*b* of the sleeve 55 and includes an outer cylindrical portion 56*a* for covering the lower outer surface of the terminal receiving portion 55*b* of the sleeve 55, and an inner cylindrical portion 56*b* connected to the lower end portion of the outer cylindrical portion 56*a* for covering the lower inner surface of the terminal receiving portion 55*b*. A groove 56*c* is formed in the inner peripheral surface of the outer cylindrical portion 56*a* to receive the ledge 55*d* of the sleeve 55.

When the terminal receiving portion 55*b* in the lower portion of the sleeve 55 is inserted into the spacing defined by the outer cylindrical portion 56*a* and inner cylindrical potion 56*b*, the ledge 55*b* is fitted in the groove 56*c*, and the busing 56 is mounted to the sleeve 55.

The bushing 56 is made of flexible silicone rubber as above noted. Thus, when the terminal 11 of the spark plug 10 is inserted into the sleeve 55 to which the bushing 56 is mounted, the inner cylindrical portion 56*b* of silicone rubber comes in intimate contact with the outer peripheral surface of the terminal 11, imparting a waterproofing property.

In the first preferred embodiment, the ledges 42 and 53 are formed on the terminal 41 and cap 51, respectively, to position the terminal 41, but the present invention is not limited thereto. For example, the terminal 41 may have a projection in place of the ledge 42. On the other hand, the cap 51 may have a projection in place of the ledge 53.

Figure 6:
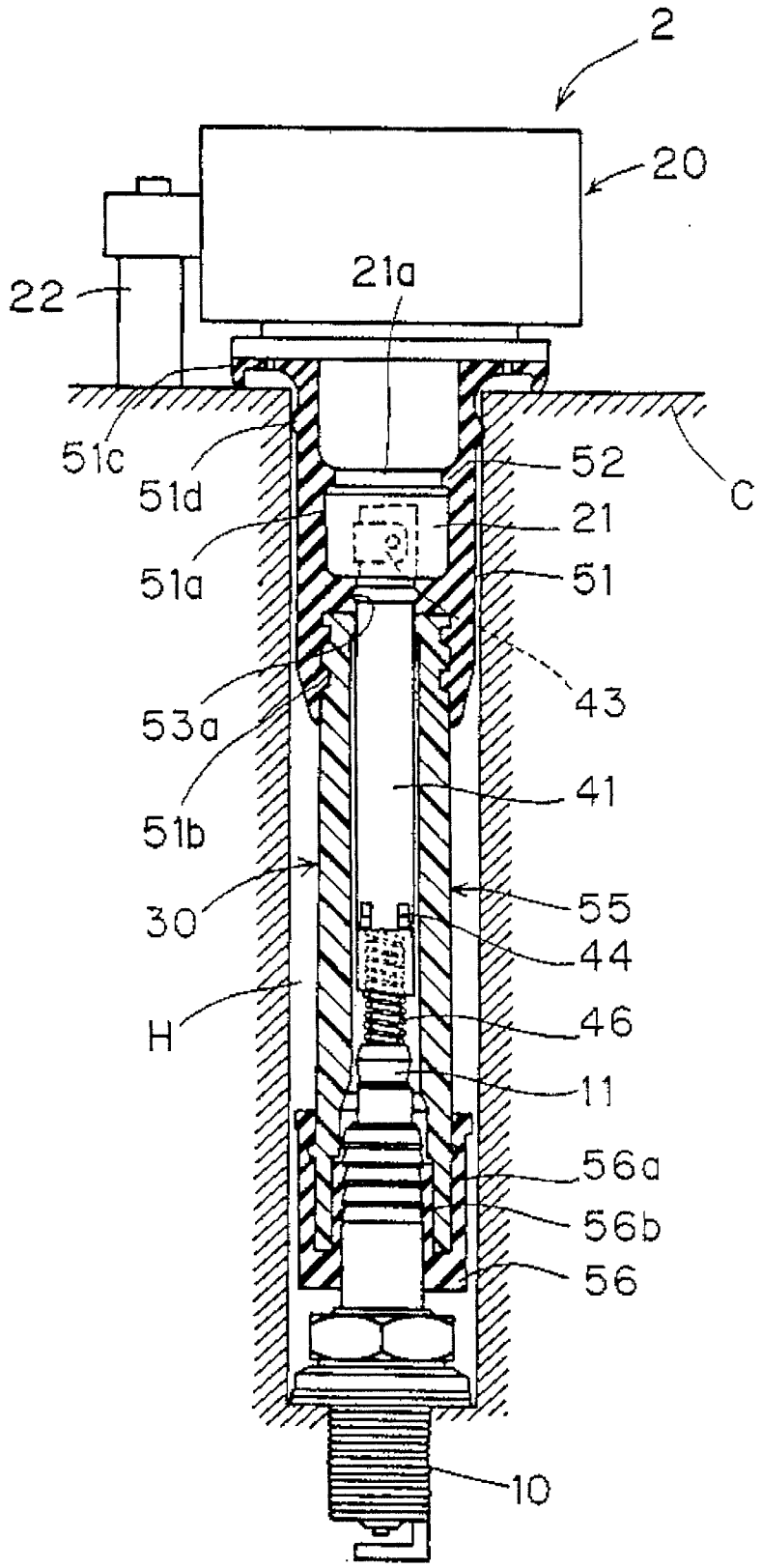
FIG. 6 is a fragmentary cross-sectional view of a second preferred embodiment according to the present invention.
Figure 7:
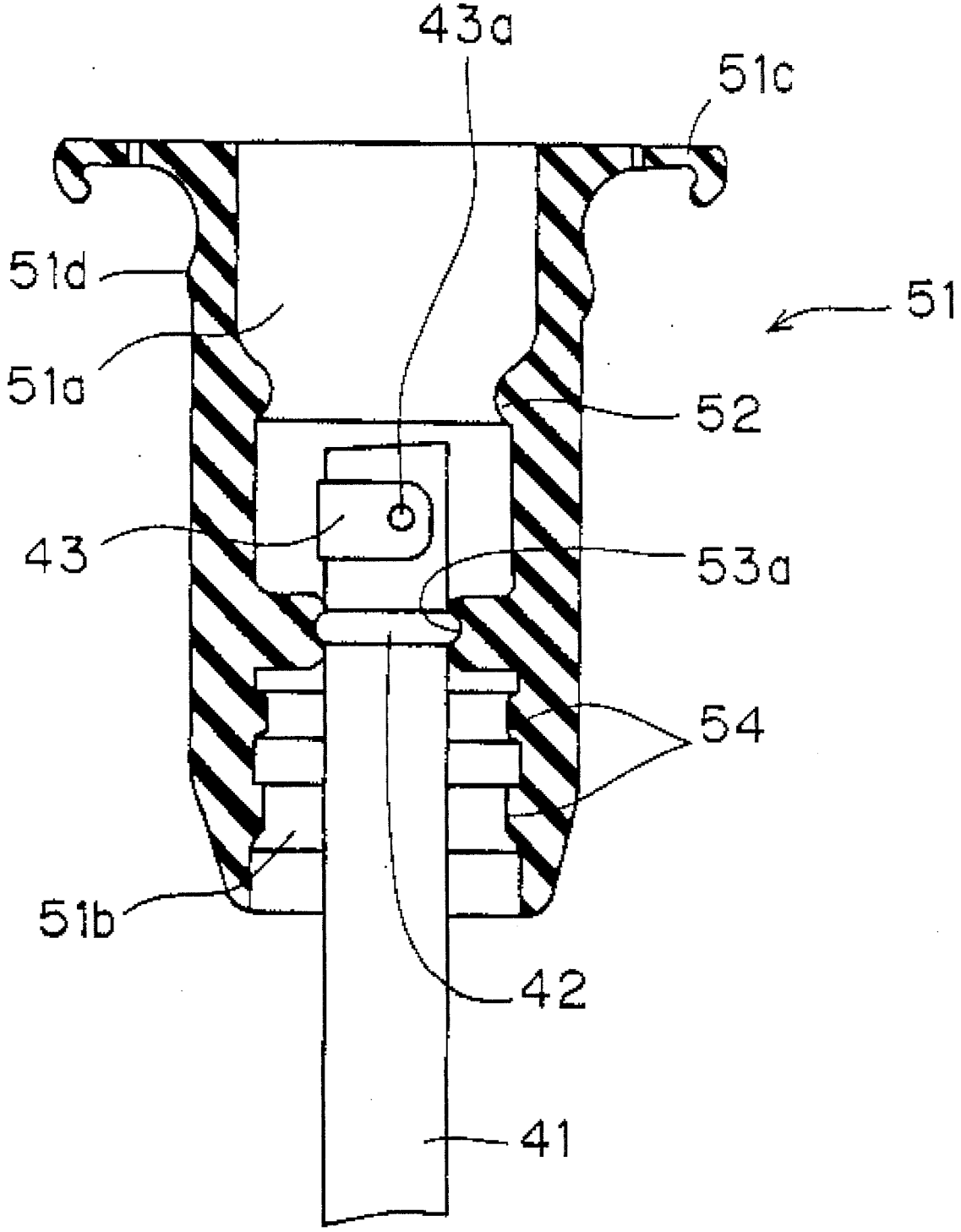
FIG. 7 is a cross-sectional view of a terminal, when positioned, of the second preferred embodiment.

FIGS. 6 and 7 illustrate a second preferred embodiment according to the present invention. An ignition system 2 for an internal combustion engine is generally similar in construction to the ignition system 1. Therefore, like reference numerals and characters are used to designate parts identical with those of the first preferred embodiment, and the description thereof will be dispensed with. Only the differences between the ignition systems 1 and 2 are described below.

The ignition system 2 differs from the ignition system 1 in the cap 51. Specifically, the terminal 41 of the ignition system 1 is positioned by locking the ledge 42 of the terminal 41 to the upper end surface of the sleeve 55 and pressing the ledge 42 by the ledge 53 of the cap 51 from above. The ignition system 2 comprises a groove 53*a* for receiving the ledge 42 of the terminal 41 in place of the ledge 53 of the cap 51.

When the terminal 41 is inserted into the sleeve 55 from above the cap 51, with the upper portion of the sleeve 55 fitted in the sleeve receiving portion 51*b* of the cap 51, then the groove 53*a* of the cap 51 receives the ledge 42 of the terminal 41, insuring the positioning of the terminal 41 in the sleeve 55.

In the second preferred embodiment, the ledge 42 to be fitted in the groove 53*a* is formed on the terminal 41 to position the terminal 41, but the present invention is not limited thereto. For example, the ledge 42 may be replaced with a projection to be fitted in the groove 53*a*.

Figure 8:
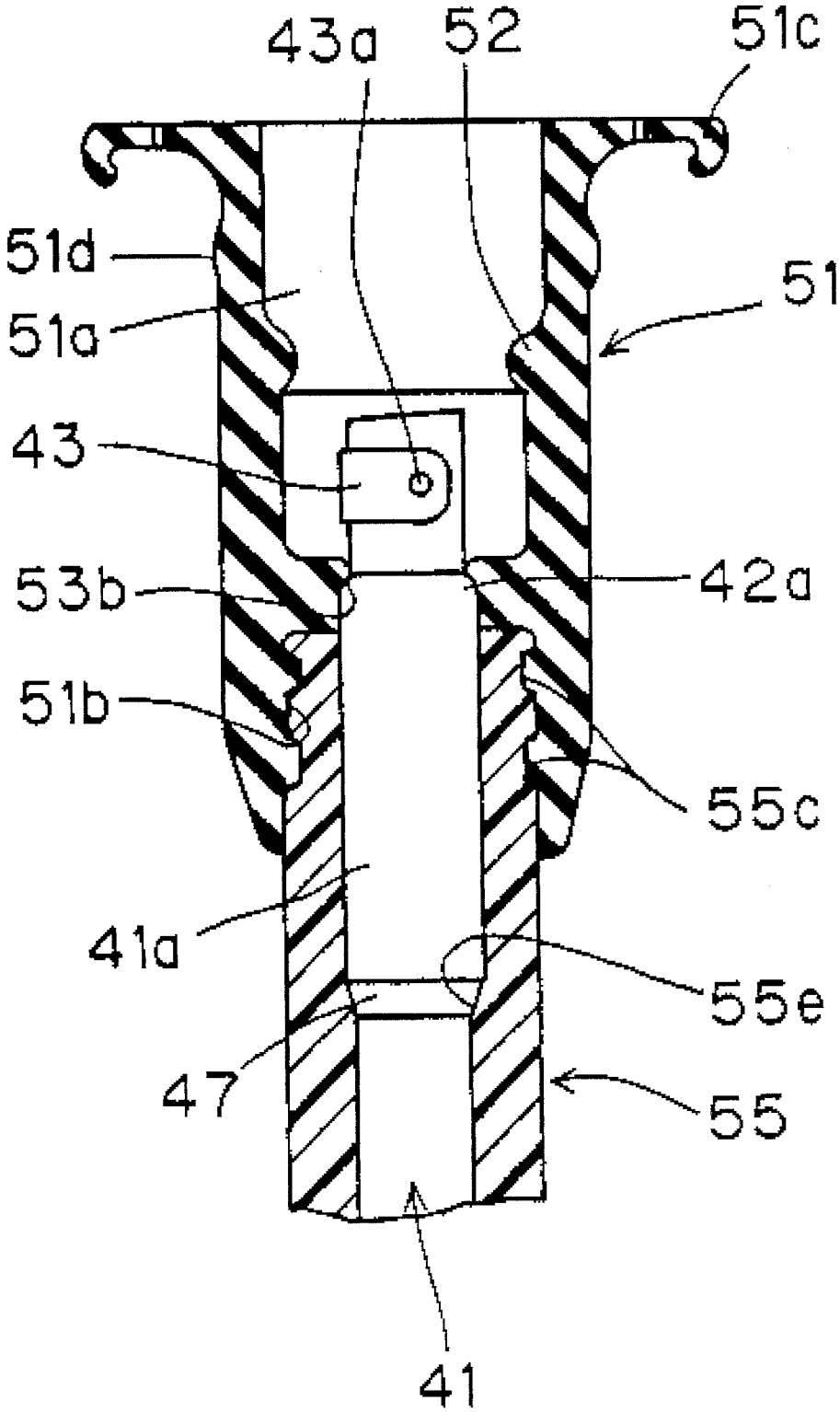
FIG. 8 is a fragmentary cross-sectional view of a third preferred embodiment according to the present invention.

FIG. 8 illustrates a third preferred embodiment according to the present invention. An ignition system for an internal combustion engine according to the third preferred embodiment differs from the ignition system 1 in the terminal 41, cap 51 and sleeve 55, which will be described below.

The terminal 41 includes a large-diameter portion 41*a* under the C-ring 43 to form a first stepped portion 42*a* and a second stepped portion 47. The sleeve 55 has a third stepped portion 55*e* for engaging the second stepped portion 47. The cap 51 has a fourth stepped portion 53*b* for engaging the first stepped portion 42*a*.

When the terminal 41 is inserted into the sleeve 55 from above the cap 51, with the upper portion of the sleeve 55 fitted in the sleeve receiving portion 51*b* of the cap 51, then the first stepped portion 42*a* of the terminal 41 comes into engagement with the fourth stepped portion 53*b* of the cap 51 to prevent the upward movement of the terminal 41, and the second stepped portion 47 of the terminal 41 comes into engagement with the third stepped portion 55*e* of the sleeve 55 to prevent the downward withdrawal of the terminal 41, thereby completely positioning the terminal 41.

While the invention has been described in detail, the foregoing description is in all aspects illustrative and not restrictive. It is understood that numerous other modifications and variations can be devised without departing from the scope of the invention.

I claim:

1. An ignition system for an internal combustion engine, comprising:

an ignition coil having a high-tension terminal;

a spark plug; and a conductor connecting portion including a conductive member for electrically connecting the high-tension terminal of said ignition coil and said spark plug, and an insulating member, said insulating member including a sleeve for receiving said conductive member, said sleeve being a molded resin component, and a cylindrical cap made of rubber and fitted on an upper end portion of said sleeve for covering an electrical connecting portion between the high-tension terminal of said ignition coil and an upper end portion of said conductive member, said conductive member having a first protrusion raised outwardly from an upper outer peripheral surface thereof and locked to an upper end surface of said sleeve, said cylindrical cap having a second protrusion on an inner peripheral surface thereof for engaging an upper side of said first protrusion to prevent said conductive member from slipping off.

2. The ignition system of claim 1, wherein said first protrusion is a projection formed on a part of the outer periphery of said conductive member, and wherein said second protrusion is a ledge formed on the inner periphery of said cylindrical cap throughout the entire circumference.

3. The ignition system of claim 1, wherein said first protrusion is a ledge formed on the outer periphery of said conducive member throughout the entire circumference, and wherein said second protrusion is a projection formed on a part of the inner periphery of said cylindrical cap.

4. An ignition system for an internal combustion engine, comprising:

an ignition coil having a high-tension terminal;

a spark plug; and a conductor connecting portion including a conductive member for electrically connecting the high-tension terminal of said ignition coil and said spark plug, and an insulating member, said insulating member including a sleeve for receiving said conductive member, said sleeve being a molded resin component, and a cylindrical cap made of rubber and fitted on an upper end portion of said sleeve for covering an electrical connecting portion between the high-tension terminal of said ignition coil and an upper end portion of said conductive member, said conductive member having a protrusion raised outwardly from an upper outer peripheral surface thereof, said cylindrical cap having a recess in an inner peripheral surface thereof for engaging said protrusion to prevent said conductive member from slipping off.

5. The ignition system of claim 4, wherein said protrusion is a projection formed on a part of the outer periphery of said conductive member.

6. The ignition system of claim 4, wherein said protrusion is a ledge formed on the outer periphery of said conductive member throughout the entire circumference.

7. An ignition system for an internal combustion engine, comprising:

an ignition coil having a high-tension terminal;

a spark plug; and a conductor connecting portion including a conductive member for electrically connecting the high-tension terminal of said ignition coil and said spark plug, and an insulating member, said insulating member including a sleeve for receiving said conductive member, said sleeve being a molded resin component, and a cylindrical cap made of rubber and fitted on an upper end portion of said sleeve for covering an electrical connecting portion between the high-tension terminal of said ignition coil and an upper end portion of said conductive member, said conductive member including a first stepped portion formed in an upper portion of an outer peripheral surface of said conductive member so that the outer diameter of a lower portion of said first stepped portion is greater than that of an upper portion thereof, and a second stepped portion formed in the outer peripheral surface of said conductive member under said first stepped portion so that the outer diameter of a lower portion of said second stepped portion is less than that of an upper portion thereof, said sleeve having a third stepped portion formed in an inner peripheral surface thereof for engaging said second stepped portion from below, said cylindrical cap having a fourth stepped portion formed in an inner peripheral surface thereof for engaging said first stepped portion from above.

* * * * *